US006255747B1

(12) United States Patent
Ramirez et al.

(10) Patent No.: US 6,255,747 B1
(45) Date of Patent: Jul. 3, 2001

(54) SAFETY MECHANISM FOR LAMPS

(76) Inventors: Sergio R. Ramirez, 10929 Long Branch Dr., Austin, TX (US) 78736; Emanuel Shah, 10300 Jollyville Rd., Austin, TX (US) 78759

( * ) Notice: Subject to any disclaimer, the term of this patent is extended or adjusted under 35 U.S.C. 154(b) by 0 days.

(21) Appl. No.: 09/391,085

(22) Filed: Sep. 4, 1999

(51) Int. Cl.[7] ..... H01H 35/00

(52) U.S. Cl. ..... 307/119; 362/395

(58) Field of Search ..... 307/157, 119; 315/119, 123, 362; 362/10, 21, 276, 802, 395; 340/907

(56) References Cited

U.S. PATENT DOCUMENTS 5,554,975 * 9/1996 Hall et al. ..... 340/573
5,722,759 * 3/1998 Eklov et al. ..... 362/80
5,733,038 * 3/1998 Wang et al. ..... 362/394
5,853,219 * 12/1998 Santuccio ..... 297/5

* cited by examiner

*Primary Examiner*—Josie Ballato
*Assistant Examiner*—Robert L Deberadinis

(57) ABSTRACT

A protection device for vertically standing lamps devices is described. The protection device consists of a switch or other means of interrupting the electrical current in case of a fall. The preferred embodiment of the invention is a normally open switch installed at the base of the lamp. This switch is closed by the action of lamp's own weight.

4 Claims, 6 Drawing Sheets

SAFETY MECHANISM FOR LAMPS

BACKGROUND

1. Field of Invention

Vertical upstanding lamps, such as the one shown in FIG. 1, have become very popular in recent years. In spite of such popularity these lamps present a fire hazard when in presence of flammable objects. The reasons for this high fire risk are the following:

First, the temperature of the lamp, usually a 300 to 600 watt quartz lamp, is very high;

and second, the center of gravity of these modern lamp designs is very high which makes the lamp very unstable and prone to falling.

The combination of high temperatures plus poor stability increases the probability that the light bulb may come into contact with a flammable surface, such as carpet, which in turn can ignite a fire.

While, in this patent application a safety mechanism as applied to a vertically standing quartz lamp as the preferred embodiment of the invention is described, the safety mechanism is also applicable to any type of lamp which poses a fire hazard when it falls.

2. Description of Prior Art

The idea of interrupting the electrical current to a device has been successfully applied to other hazardous conditions, which arise from the operation of electric devices. In U.S. Pat. No. 5,576,683, Rose describes a Thermostat with thermal insulator for protection against overheating in which the electrical current is cut after a threshold temperature has been reached. In U.S. Pat. No. 4,973,936, Dimpault and Darcy describe a thermal switch for short circuit protection of batteries, which cuts the battery current in the event of a short circuit.

In general, the concept of a circuit breaker which interrupts the electrical current when a hazardous situation arises (machine is blocked, the current is excessive, the temperature is above a threshold) has been used in the referred patents and in other inventions. This idea is also of common use in the protection of electrical installations in houses and other buildings.

In the case of vertically standing lamps, the protection against the fire hazard in case of a fall has not been addressed using the general idea of interrupting the electric current to remove the source of heat. In order to increase the safety of vertically standing lamps such as the one shown in FIG. 1, these lamps come assembled with a protective grid on the light bulb as shown in FIG. 2. This grid can be made either of plastic, metal or other material. The purpose of the grid is to prevent the light bulb from coming directly into contact with the flammable materials in case of a fall. The grid effectively reduces the fire hazard by isolating the source of heat from the flammable materials rather than eliminating the source of heat. Because the grid only isolates the source of heat rather than eliminating it, there is still a certain degree of risk since the grid becomes hot and may ignite a highly flammable material such as paper. There have been many incidents in which a lamp, such as the one described in this application, has caused a fire when it fell on top of a flammable surface.

OBJECT OF THE INVENTION

It is the object of this invention to provide a mechanism to turn off the lamp when the lamp falls. By removing the source of heat, i.e. the lamp turned on, in case of a fall, the risk of starting a fire will be almost eliminated.

BRIEF DESCRIPTION OF DRAWING

In the accompanying drawings, which are incorporated in and constitute a part of this specification, embodiments of the invention are illustrated, which, together with a general description of the invention given above, and detailed description given below, sere to exemplify the principles of this invention.

DETAILED DESCRIPTION OF THE INVENTION

The general functioning principle of the invention is to connect a switch or other type of circuit breaker in series will all other switches and dimmers, which form the lamp's electrical circuit. The purpose of this switch is to interrupt the current supply to the lamp when the lamp is not standing up-right.

Figure 1:
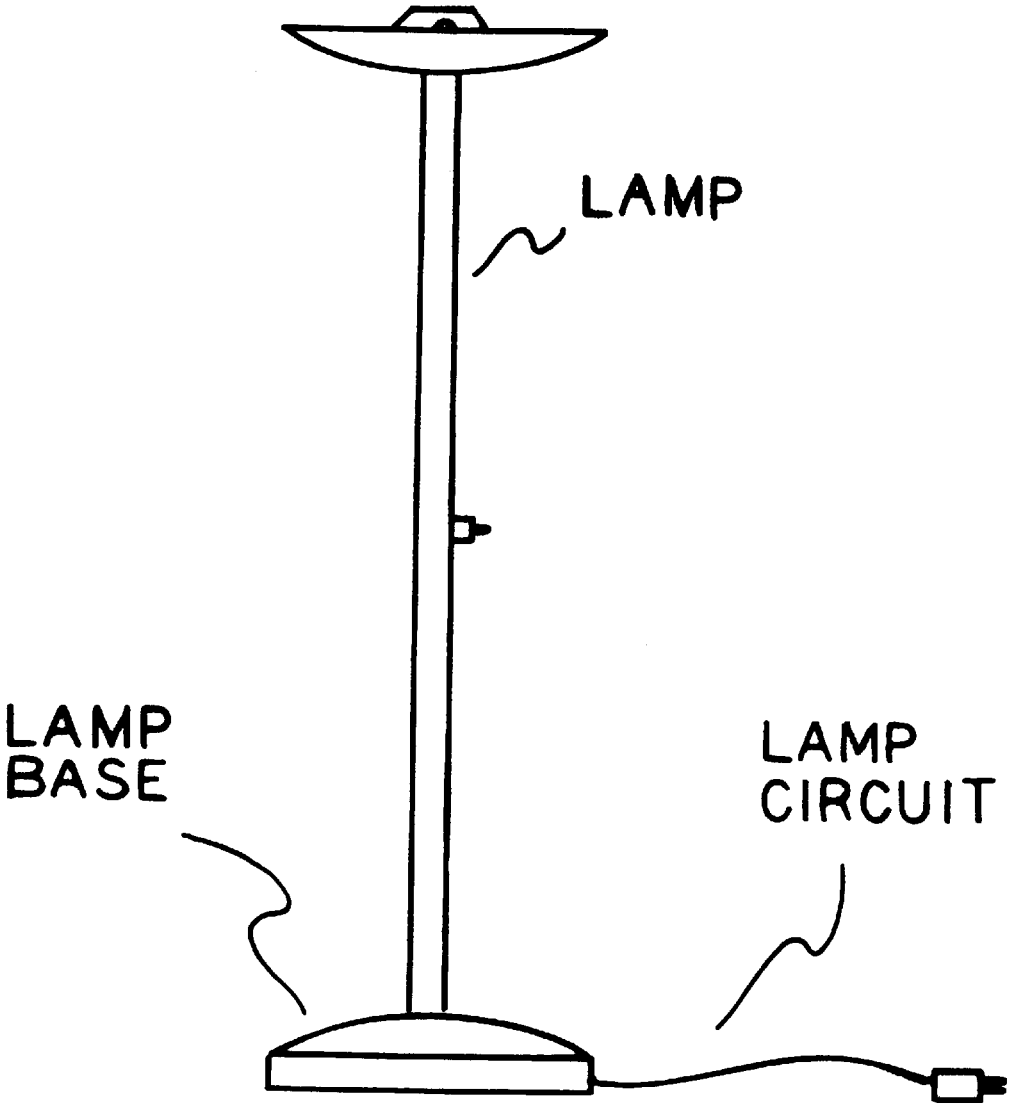
FIGURE 1 PRIOR ART
FIG. 1 is a diagram illustrating a standard floor lamp.
Figure 2:
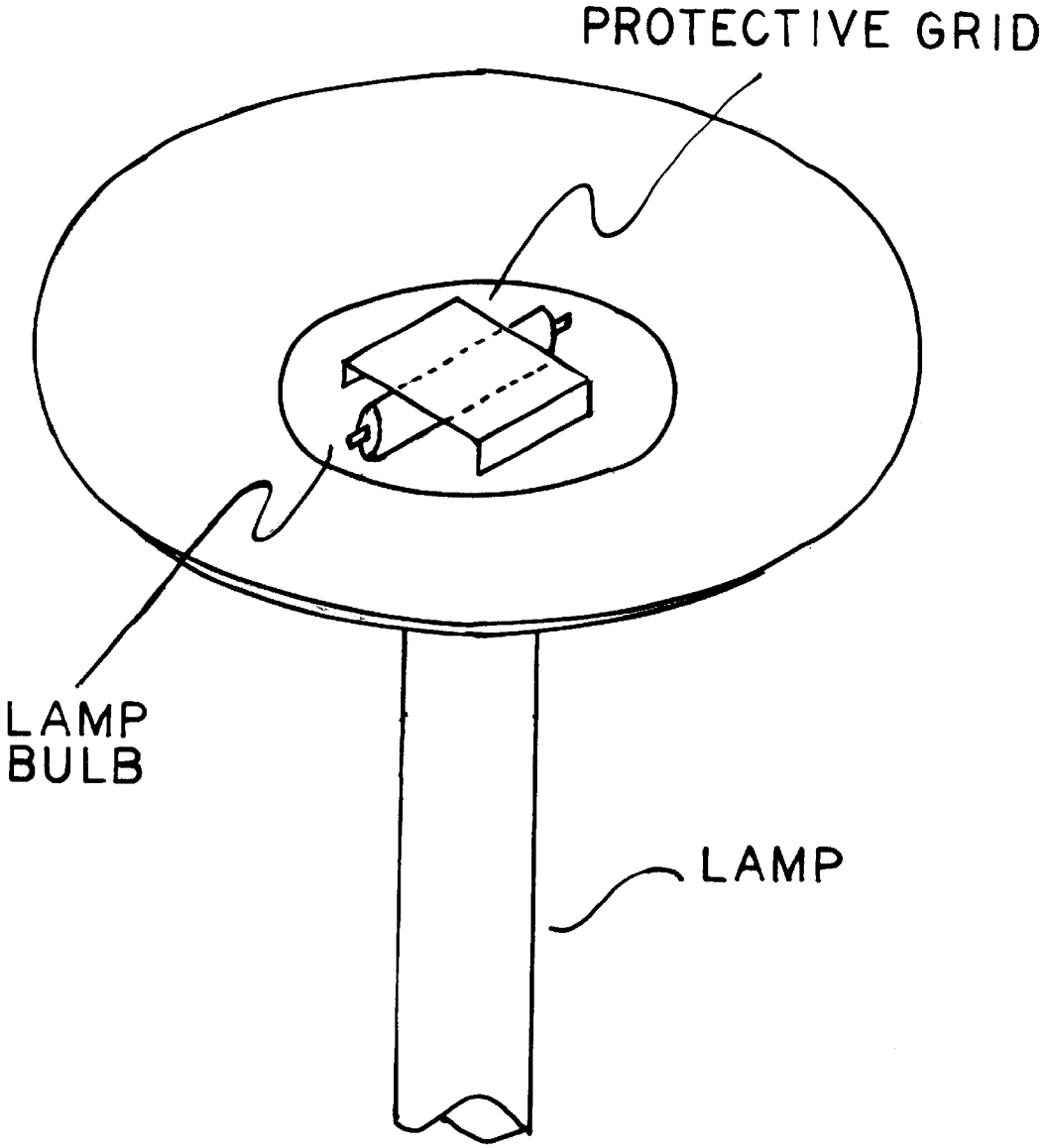
FIGURE 2 PRIOR ART
FIG. 2 illustrates a protective grid.
Figure 3:
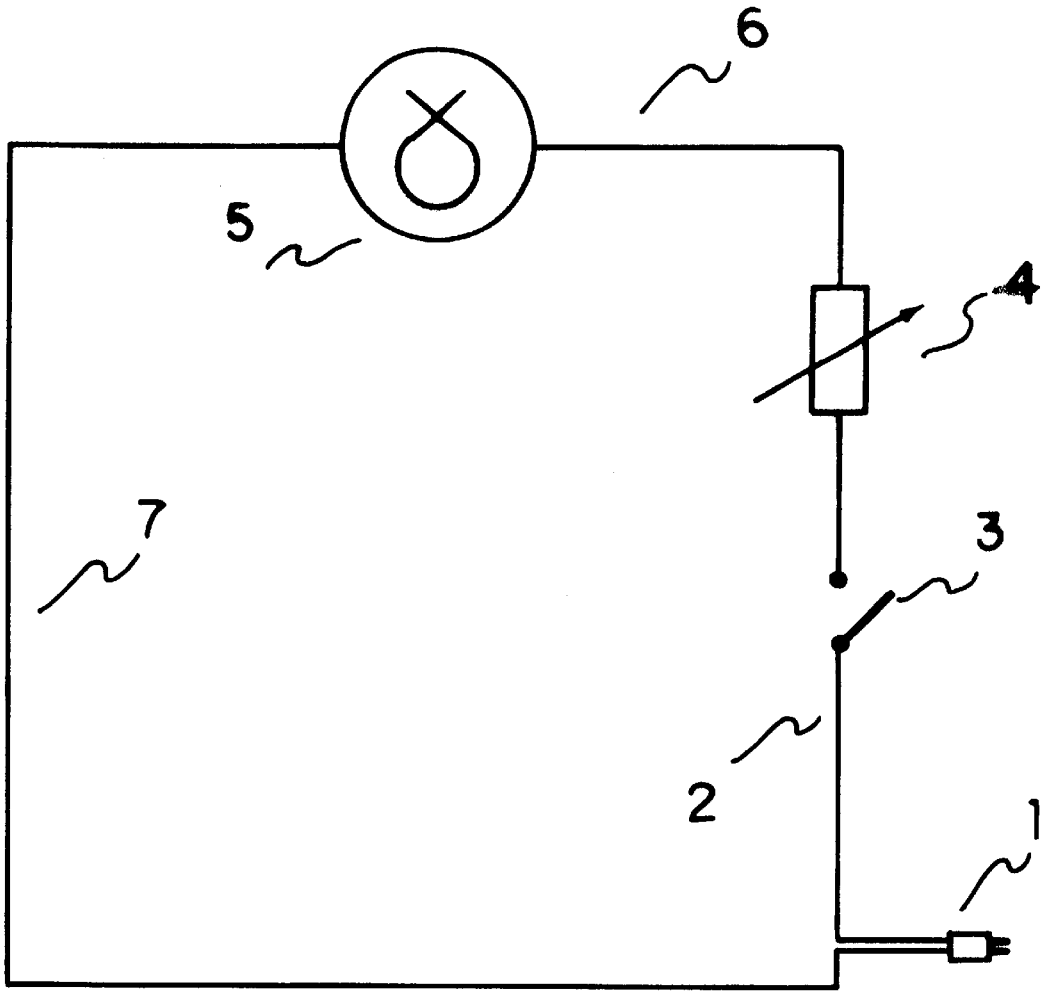
FIGURE 3 PRIOR ART
FIG. 3 shows a lamp circuit without the claimed extra protective device.

FIG. 3 contains a circuit diagram of a lamp without the extra protection device. The utility source of electricity is connected to the lamp through the plug, number 1, in series with wire, number 2, (the hot wire), which is connected in series with a main switch, number 3, to an optional dimmer, number 4. The dimmer circuit is then connected to the lamp bulb, number 5, by wire, number 6, (the return wire). To close the circuit, the other terminal of the lamp bulb is connected back to the plug by wire, number 7 (the neutral wire).

The switch, number 4, and the dimmer, number 5, may be provided in a combination switch/dimmer assembly. This combination does not affect the working principle of the lamp.

Since the lamp circuit is a series circuit, there are other possible permutations of the lamp bulb-dimmer-switch-plug series connection, which would provide a working embodiment of the lamp.

Figure 4:
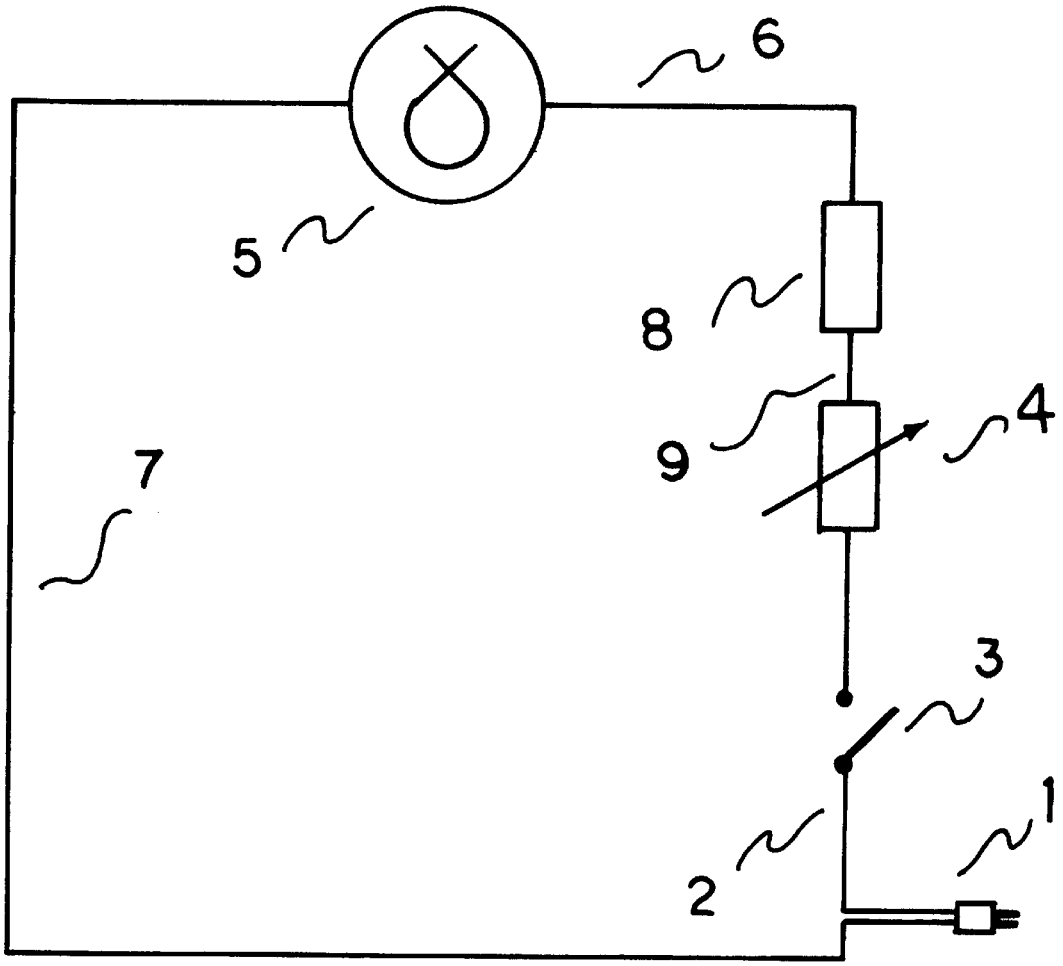
FIG. 4 shows a lamp circuit with the claimed extra protective device.

FIG. 4 contains a circuit diagram of the preferred embodiment of the invention. In this circuit, the plug, number 1, is connected in series with the hot wire, number 2; in series with the main switch, number 3, and the dimmer, number 4. The additional protection device, number 8, is connected in series with the dimmer number 4 by an extra wire number 9 and to the lamp bulb, number 5 by wire number 6 (the return wire). To close the circuit, the other terminal of the lamp bulb is connected back to the plug by wire, number 7 (the neutral wire). The function of the additional protection device, number 8, is to first, detect that the lamp is not in the vertical position, and second to open the circuit when the off vertical condition is detected.

As in the prior art, the switch, number 4, and the dimmer, number 5, may be provided in a combination switch/dimmer assembly. This combination does not affect the working principle of the lamp. This is also the reason why the wire between the switch and the dimmer is not labeled in the figures.

The protection device, number 8, can be implemented as a switch, which opens the circuit in case of a fall. Other protection devices, such as a position sensor and a relay can be used provided that they interrupt the current when the lamp is not in the upright position.

In the case of a lamp fall, the additional protection device will open the series circuit and will turn off the lamp. By turning the lamp off, the additional protection device will remove the source of heat which will, in turn, greatly reduce the fire hazard since the only heat source left will be the residual heat in the lamp's surfaces.

Similarly to the prior art, the series combination of lamp bulb-dimmer-switch-plug-protection device-plug can have many series permutations, which will provide a working embodiment of the invention. Also, similarly to the prior art, the main switch-dimmer or the main switch-dimmer-protection switch may be supplied in a single assembly without affecting the working principle of the invention.

Figure 5:
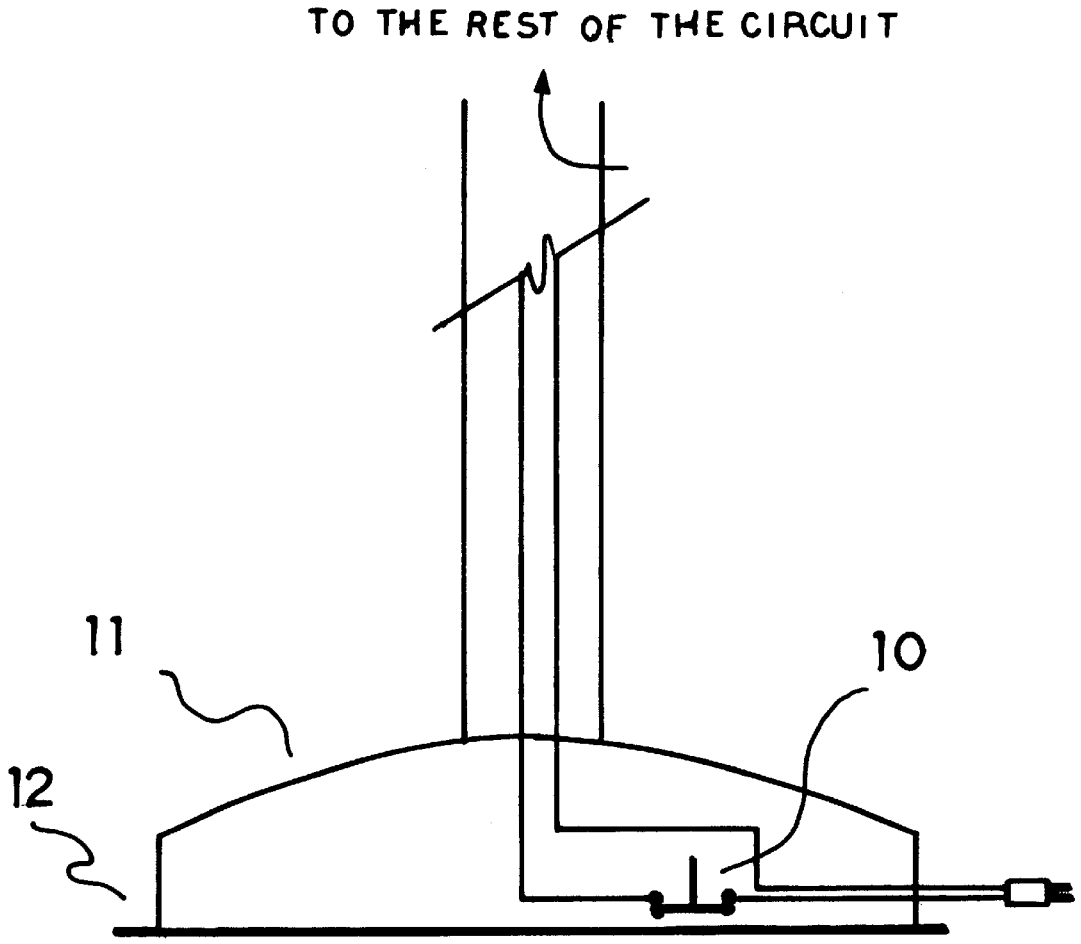
FIG. 5 shows the extra protective device installed in the base of a floor lamp.

The preferred embodiment of protection device (number 8 in FIG. 4) is a switch installed at the base of the lamp as shown in FIG. 5. The switch, number 10, is a switch of the normally open type. This switch is installed at the base of the lamp, number 11, in such a way that it is closed when the lamp is standing in the vertical position by action of the lamp's own weight against the floor, number 12. When the lamp is not standing in the vertical position, the normally open switch will no longer be closed by the action of the lamp's weight and therefore will interrupt the supply of current to the lamp turning the lamp off. This is the simplest embodiment of the invention since both functions of position sensing and circuit opening are implemented by the switch at the lamp's base.

In another embodiment of the invention, the protection device can be implemented by a relay in combination with a position sensor, which detects that the lamp is not standing vertically. The position can be implemented by a switch at the base of the lamp or by a position sensitive device such as a mercury switch.

Figure 6:
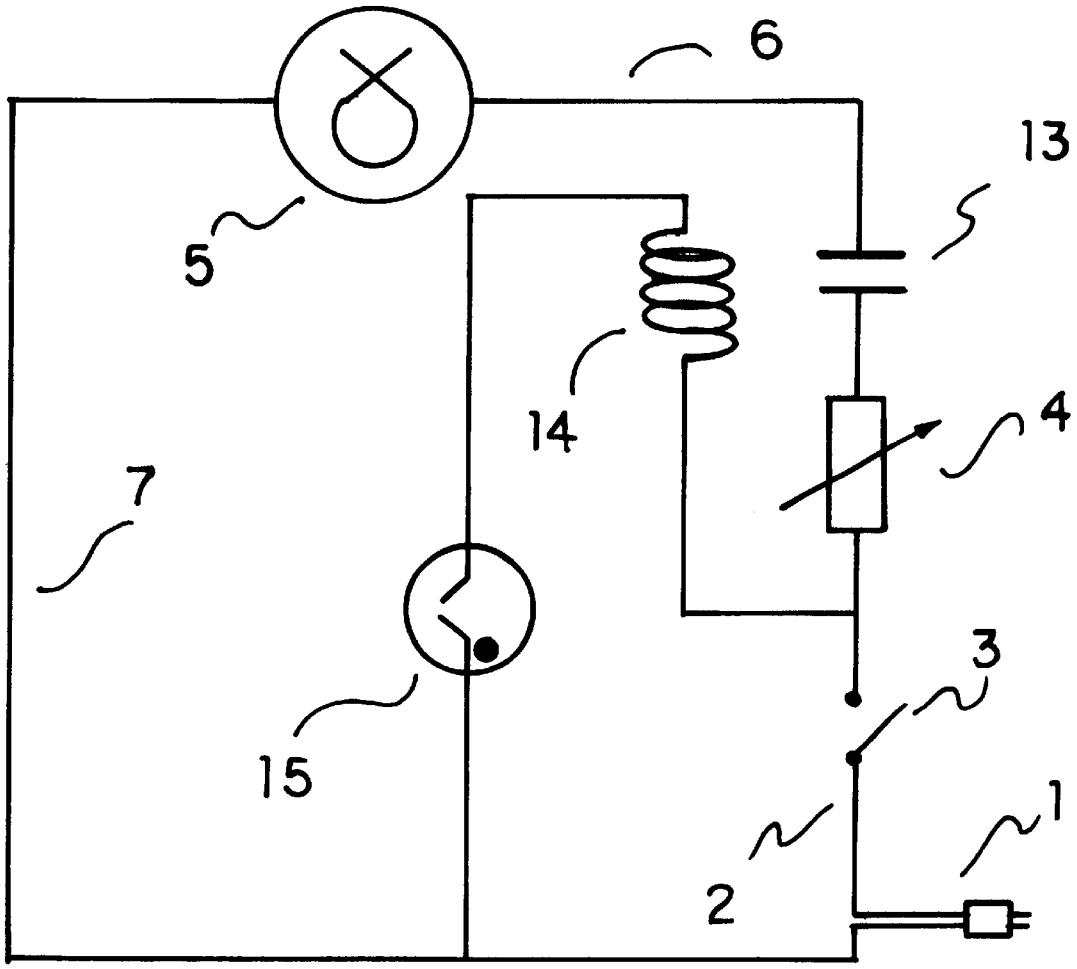
FIG. 6 shows the protective device implemented by a position sensor.

FIG. 6 shows a possible embodiment of the protection device as implemented by a position sensor and a normally closed relay. The principle of operation is very similar to the preferred embodiment as follows: First, the utility power is connected to the circuit via the plug, number 1. This is connected in series with the hot wire, number 2, in series with the main switch, number 3, in series with the optional dimmer assembly, number 4. This combination is in series with the relay contacts, number 13, which in this case embody the circuit opening function of the protection device. For this embodiment of the invention, we assume that the relay is of the normally closed type. The relay contacts, number 13, are then connected to the lamp bulb, number 5, via the return wire number 6. The circuit is then closed by the neutral wire, number 7. This series circuit (the main circuit) is connected in parallel with the circuit formed by the plug/power source, number 1, the hot wire, number 2, the main switch, number 3, the relay coil, number 14 and the position sensor number 15. Assuming that the position sensor closes the circuit formed by elements 1, 2, 3, 14 and 15 (the control circuit) when the lamp falls, and also assuming that the main switch, number 3 is closed (the lamp is on), the relay contacts, number 13 will be open because the coil, number 14 is energized. By this action of the relay, the circuit formed by elements 1, 2, 3, 4, 5, 6, 7 and 13 (the main circuit) will be open, effectively turning the lamp off and removing the source of heat. In this embodiment of the invention, the position sensor can be implemented by a mercury switch, which detects when the lamp is not vertical or by a switch at the lamp's base. Both, the base switch or the mercury switch would energize the coil number 14 when the lamp falls. A switch installed at the base of the lamp can also be used as a position sensor to energize the relay instead of directly opening the main circuit as in the preferred embodiment of the invention.

There are other combinations that also provide a working embodiment of the invention. For example, the relay contacts, number 13, can be of the normally open type combined with a position sensor which closes the circuit 1, 2, 3, 14, 15 (the control circuit) only when the lamp is in the vertical position. Therefore, in case of a fall, the position sensor would open the control circuit, which in turn will de-energize the relay coil 14, which would in turn open the main circuit and turn the lamp off.

It must be noted that the main switch number 3, need not be part of the control circuit in order to have a working embodiment of the invention. The switch circuit is also placed as part of the control circuit in order to avoid the unnecessary energizing of the relay coil when the lamp is turned off by action of the main switch.

It must also be noted that since the main and the control circuits individually are series connections of various elements, therefore there are other permutations of the elements of each circuit that provide a working embodiment of the invention.

ADVANTAGES OF THIS INVENTION

The main advantage of this invention is increased safety, when this invention is compared to the prior art (placing a grid on top of the lamp to increase safety). This invention eliminates the source of heat by turning the lamp off. The prior art simply isolates the source of heat but does not eliminate it. By turning the lamp off, in the case of a fall, this invention improves the safety of all lamps regardless of whether a safety grid is used or not.

A secondary advantage of this invention is the reduction of cost since the safety grid becomes unnecessary, and ease of maintenance since it becomes easier to change a light bulb once the safety grid has been eliminated.

CONCLUSION

The invention improves the safety of any vertically standing electrical device, which is prone to a hazard in case of a fall.

What is claimed is:

1. A protection device for a lamp which includes a vertically standing lamp; a lamp base; and a lamp circuit consisting of a series connection of a switch, an optional dimmer, a lamp bulb, a plug, wiring and the said protective device comprising: one sensor unit which detects when the lamp is not in the vertical position; and means of opening the said series circuit when the said sensor unit detects that the lamp is not in the vertical position.

2. The protection device as claimed in claim 1, wherein the said sensor unit and the said means of opening the said lamp circuit are embodied together by a switch mounted at the said lamp base so as to close the said lamp circuit when the lamp is in the vertical position and open the said lamp circuit when the lamp is not in the vertical position.

3. The protection device as claimed in claim 1 wherein the said means of opening the said series circuit are embodied by a relay and wiring connecting the said relay to the said sensor unit, and the said sensor unit is implemented by a position sensitive mercury switch connected so as to actuate the said relay to open the said lamp circuit when the said lamp is not in the vertical position.

4. The protection device as claimed in claim 1 wherein the said means of opening the said series circuit are embodied by a relay and wiring connecting the said relay to the said sensor unit, and the said sensor unit is implemented by a switch mounted at the said lamp base so as to actuate the said relay to open the said lamp circuit when the said lamp is not in the vertical position.

* * * * *